US012225996B2

(12) United States Patent
Hwang

(10) Patent No.: US 12,225,996 B2
(45) Date of Patent: Feb. 18, 2025

(54) COSMETIC CONTAINER

(71) Applicant: F.S.KOREA INDUSTRIES INC., Seoul (KR)

(72) Inventor: Jae Kwang Hwang, Seoul (KR)

(73) Assignee: F.S.KOREA INDUSTRIES INC., Seoul (KR)

( * ) Notice: Subject to any disclaimer, the term of this patent is extended or adjusted under 35 U.S.C. 154(b) by 269 days.

(21) Appl. No.: 17/868,601

(22) Filed: Jul. 19, 2022

(65) Prior Publication Data

US 2023/0022261 A1 Jan. 26, 2023

(30) Foreign Application Priority Data

Jul. 21, 2021 (KR) ..... 10-2021-0095812

(51) Int. Cl.
*A45D 40/00* (2006.01)
*A45D 34/04* (2006.01)

(52) U.S. Cl.
CPC ..... *A45D 34/04* (2013.01); *A45D 40/0075* (2013.01)

(58) Field of Classification Search
CPC ..... A45D 34/00; A45D 34/02; A45D 34/04; A45D 34/042; A45D 34/043; A45D 34/045; A45D 34/046; A45D 34/047; A45D 34/048; A45D 40/0068; A45D 40/0075; A45D 40/24; A45D 40/26; A45D 40/264; A45D 40/265; A45D 40/267; A45D 40/268; B05B 11/309; B05B 11/3045
USPC ..... 141/23, 24, 25
See application file for complete search history.

(56) References Cited

U.S. PATENT DOCUMENTS

2014/0361047 A1* 12/2014 Lee ..... G01F 11/028 222/372
2015/0232240 A1* 8/2015 Lee ..... A45D 34/04 220/288
2017/0079407 A1* 3/2017 Chen ..... A45D 34/04
2017/0231365 A1* 8/2017 Choi ..... A45D 34/04 222/383.1
2019/0053600 A1* 2/2019 Kim ..... A45D 34/045
2021/0112945 A1* 4/2021 Jacob ..... A45D 34/04
2021/0251366 A1* 8/2021 Zhong ..... A45D 34/04
2022/0015523 A1* 1/2022 Ohn ..... B05B 11/061
2022/0248827 A1* 8/2022 Holtzman ..... A45D 34/00
2024/0156233 A1* 5/2024 Hwang ..... A45D 34/04
2024/0172857 A1* 5/2024 Hwang ..... A45D 34/00

* cited by examiner

*Primary Examiner* — Rachel R Steitz
*Assistant Examiner* — Karim Asqiriba
(74) *Attorney, Agent, or Firm* — Lucem, PC; Heedong Chae

(57) ABSTRACT

Disclosed is a cosmetic container. The cosmetic container of the present disclosure includes a container body in which cosmetic contents are stored, a cap part coupled to the container body and having a pipette member, and an elastic pumping part coupled to the cap part to suck or eject the cosmetic contents stored in the container body with the pipette member, wherein the elastic pumping part includes a wall portion coupled directly to a side wall of the cap part and a ceiling portion provided on the wall portion and moving toward the pipette member to provide a pumping force for sucking or ejecting the cosmetic contents into the pipette member, the ceiling portion is provided with an elastic material including rubber, and the wall portion is coupled directly to the side wall of the cap part.

3 Claims, 4 Drawing Sheets

COSMETIC CONTAINER

CROSS-REFERENCE TO RELATED APPLICATIONS

This application claims the priority of Korean Patent Application No. 10-2021-0095812 filed on Jul. 21, 2021, in the Korean Intellectual Property Office, the disclosure of which is incorporated herein by reference.

BACKGROUND OF THE INVENTION

Field of the Invention

The present disclosure relates to a cosmetic container, and more particularly, to a cosmetic container in which an elastic pumping part for sucking or ejecting cosmetic contents into or from a pipette member is directly coupled to a cap part to simplify a structure.

Description of the Related Art

In general, as a method of using liquid cosmetic contents, which preferably uses a small amount at a time, but uses a precise quantity, in the related art, a method of individually packaging the contents in the form of capsules or the like by an amount to be used every use time was used. However, such an individually packaging method is inefficient because a relatively large amount remains inside the capsule even after a user uses the contents.

In order to overcome the disadvantage of such an individually packaging method, there is disclosed a configuration in which the cosmetic contents are received in a container and then ejected using an ejection means having a general spuit or syringe structure or using an ejection means having a component of a push pump. There is disclosed "a spuit type container cap for automatic filling" in Korean Patent Registration No. 10-1465886.

However, in the case of the general spuit-type ejection means, the amount to be sucked and ejected varies depending on the degree of pressing a pressing part made of rubber by the user. Accordingly, there is a disadvantage that it is impossible or very difficult to accurately eject a constant amount each time it is used.

In addition, in the case of using the ejection means of the syringe structure, a very small amount of about 1 ml is mostly used. Accordingly, there are structural problems such as extremely small diameter of the syringe or extremely small stroke of a syringe piston. In addition, since in order to eject the contents, the contents are sucked by pulling the piston of the syringe, and then the contents need to be ejected by pushing the piston of the syringe again, there was a disadvantage that it was very cumbersome to use.

Meanwhile, in the case of the ejection means having the component of the push pump, there is an advantage that a certain amount of contents may be ejected whenever simply pressing the button. However, since a structure for forming the inside and outside of the pump is configured by including a button, a suction port, an ejection port, a spring, a valve structure, etc, the configuration thereof is complicated, and thus improvement measures are required.

The above-described technical configuration is the background art for helping in the understanding of the present disclosure, and does not mean a conventional technology widely known in the art to which the present disclosure pertains.

SUMMARY OF THE INVENTION

The present disclosure has been made in an effort to provide a cosmetic container in which an elastic pumping part for sucking or ejecting cosmetic contents into or from a pipette member is directly coupled to a cap part to simplify a structure.

According to an aspect of the present disclosure, there is provided a cosmetic container including a container body in which cosmetic contents are stored, a cap part coupled to the container body and having a pipette member, and an elastic pumping part coupled to the cap part to suck or eject the cosmetic contents stored in the container body with the pipette member, wherein the elastic pumping part includes a wall portion coupled directly to a side wall of the cap part and a ceiling portion provided on the wall portion and moving toward the pipette member to provide a pumping force for sucking or ejecting the cosmetic contents into the pipette member, the ceiling portion is provided with an elastic material including rubber, and the wall portion is coupled directly to the side wall of the cap part.

The elastic pumping part may further include a protrusion portion provided inside the ceiling portion and protruding toward the pipette member to structurally reinforce an central portion of the ceiling portion.

A thickness of the ceiling portion in a region where the ceiling portion and the side wall are in contact with each other may be the thickest, a thickness of the ceiling portion in a region in contact with the protrusion portion may be the thinnest, and a thickness obtained by summing the thickness of the protrusion portion and the thickness of the ceiling portion provided with the protrusion portion may be provided to be equal to the thickness of the ceiling portion.

The cap part may include a cap body detachably coupled to the container body, an extension body provided to extend from an outer lower end of the cap body and coupled directly with the wall portion, a first space portion provided between an upper surface of the cap body and the ceiling portion, and a second space portion provided between the cap body and the extension body, wherein the volume of the first space portion may be larger than the volume of the second space portion.

According to the embodiments of the present disclosure, the elastic pumping part includes the wall portion coupled to the side wall of the cap part and the ceiling portion provided on the wall portion and moved toward the pipette member to provide a pumping force for sucking or ejecting the cosmetic contents into the pipette member, and the ceiling portion is provided with an elastic material including rubber and the wall portion is coupled directly to the side wall of the cap part, thereby simplifying the structure.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
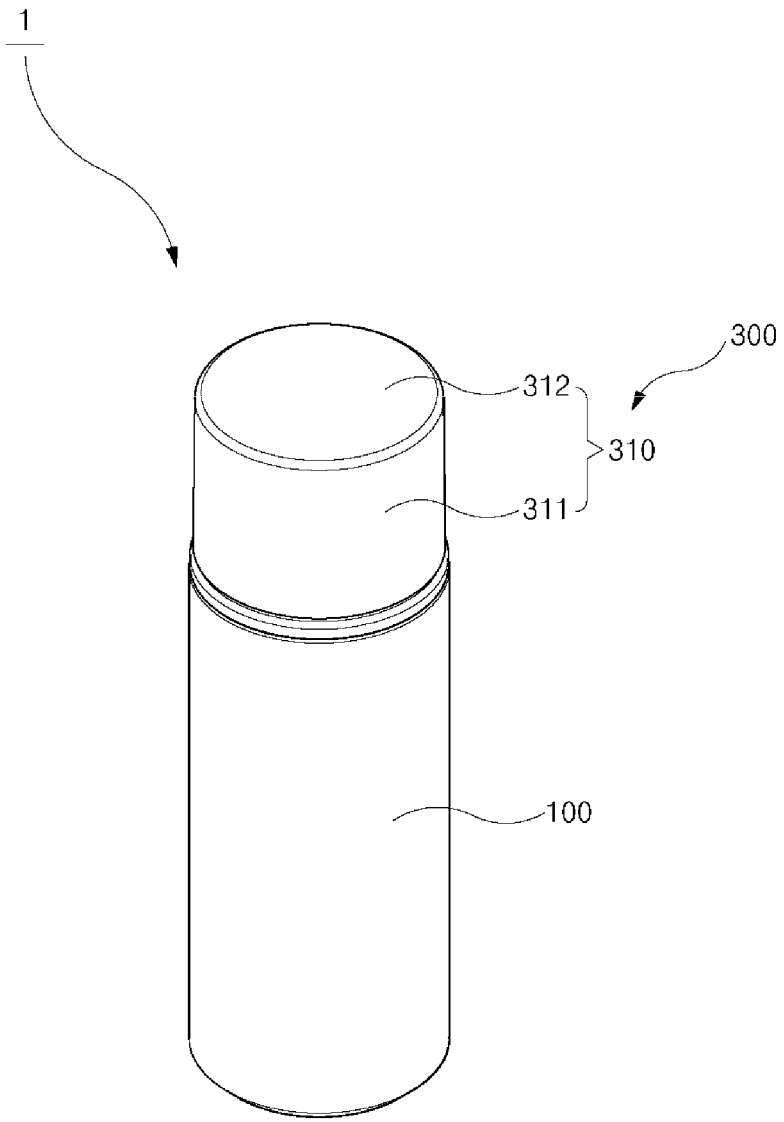
FIG. 1 is a diagram schematically illustrating a cosmetic container according to an embodiment of the present disclosure.

In order to fully understand the present disclosure, operational advantages of the present disclosure and objects to be achieved by implementing the present disclosure, the present disclosure will be described with reference to the accompanying drawings which illustrate preferred embodiments of the present disclosure and the contents illustrated in the accompanying drawings.

Hereinafter, preferred embodiments of the present disclosure will be described in detail with reference to the accompanying drawings. Like reference numerals illustrated in the respective drawings designate like members.

Figure 2:
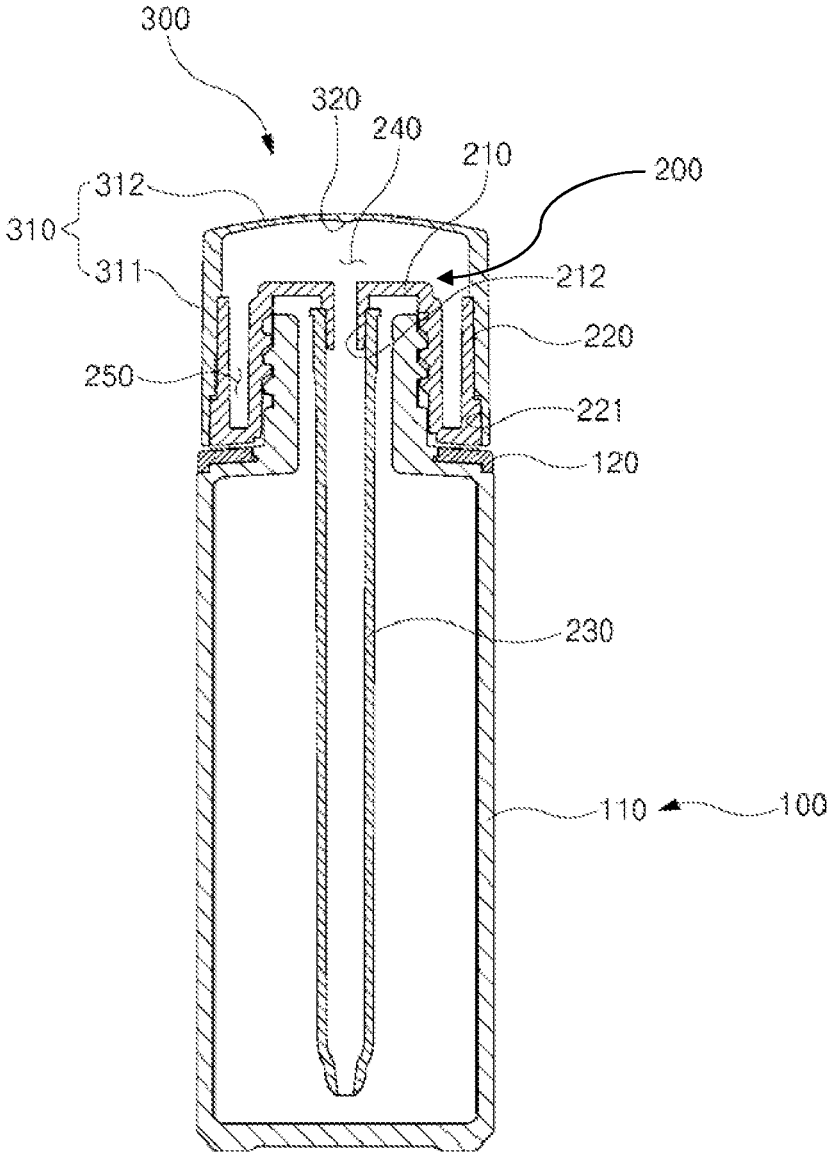
FIG. 2 is a cross-sectional view of FIG. 1.
Figure 3:
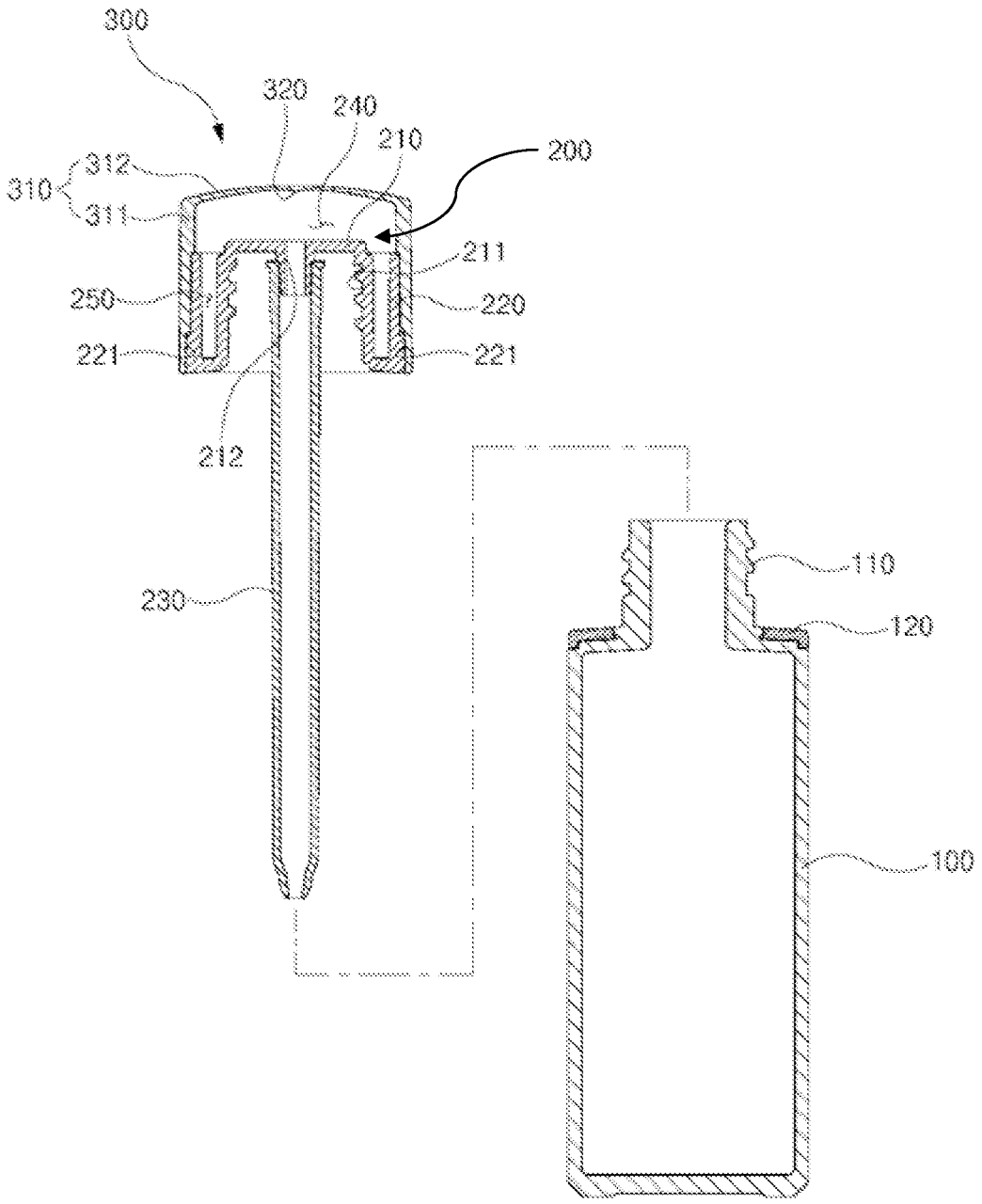
FIG. 3 is an exploded cross-sectional view of FIG. 2.
Figure 4:
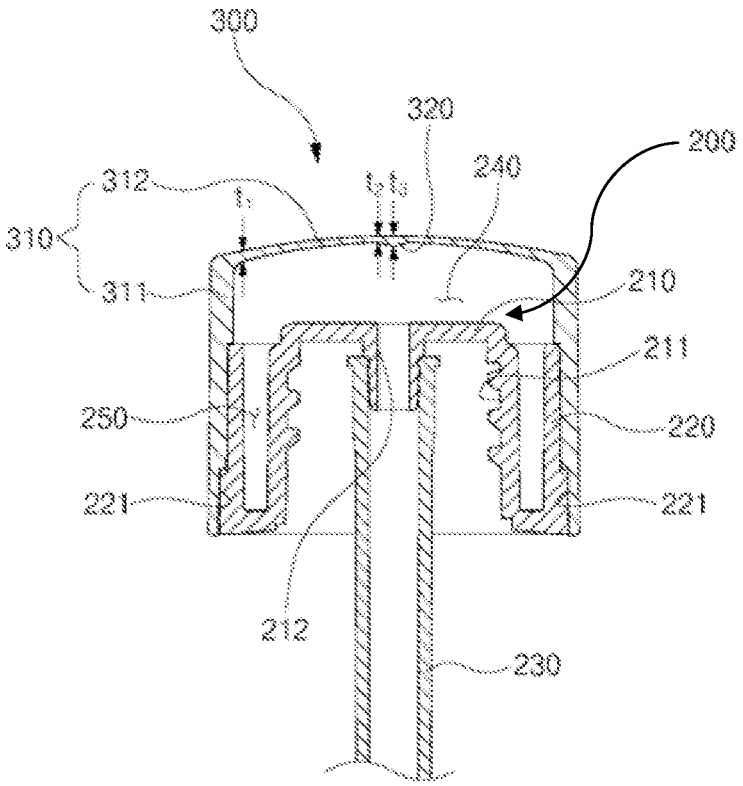
FIG. 4 is an enlarged diagram illustrating a region of an elastic pumping part illustrated in FIG. 2.

FIG. 1 is a diagram schematically illustrating a cosmetic container according to an embodiment of the present disclosure, FIG. 2 is a cross-sectional view of FIG. 1, FIG. 3 is an exploded cross-sectional view of FIG. 2, and FIG. 4 is an enlarged diagram illustrating a region of an elastic pumping part illustrated in FIG. 2.

As illustrated in these drawings, a cosmetic container 1 according the present embodiment includes a container body 100 in which cosmetic contents are stored, a cap part 200 coupled to the container body 100 and having a pipette member 230, and an elastic pumping part 300 coupled to the cap part 200 to suck or eject the cosmetic contents stored in the container body 100 with the pipette member 230.

The container body 100, as illustrated in FIG. 1, may have a cylindrical shape, and liquid cosmetic contents may be stored therein.

In the present embodiment, on an upper portion of the container body 100, as illustrated in FIGS. 2 and 3, a body thread 110 may be provided, and the body thread 110 may be screwed by engaging with a cap thread 211 of a cap body 210 illustrated in FIG. 3.

In addition, in the present embodiment, on the upper portion of the container body 100, as illustrated in FIG. 3, a packing member 120 may be provided.

As illustrated in FIG. 2, the cap part 200 may be coupled to the upper portion of the container body 100 to cover an opened upper region of the container body 100 and further, may be provided as a coupling place for the pipette member 230.

In the present embodiment, the cap part 200, as illustrated in FIG. 2, includes the cap body 210 detachably coupled to the upper portion of the container body 100, an extension body 220 provided to extend from an outer lower end of the cap body 210 and coupled directly with the elastic pumping part, a first space portion 240 provided between an upper surface of the cap body 210 and a ceiling portion 312 of the elastic pumping part 300, and a second space portion 250 provided between the cap body 210 and the extension body 220.

As illustrated in FIG. 2, in the cap body 210 of the cap part 200, a cap thread 211 is provided on an inner wall thereof to be screwed with the body thread 121 of the container body 100.

In the present embodiment, as illustrated in FIG. 3, a pipette coupling portion 212 is provided at an inner central portion of the cap body 210, and an upper end of the pipette member 230 may be detachably coupled, for example, fitted to the pipette coupling portion 212.

In addition, in the present embodiment, the central portion of the cap body 210 has an opening hole, so that air in the first space portion 240 flows into the pipette member 230 through the opening hole or, conversely, moves from the pipette member 230 to the first space portion 240 through the opening hole.

As illustrated in FIG. 4, the extension body 220 of the cap part 200 is provided to extend outwards from the outer lower end of the cap body 210 to be provided as a direct coupling place of the elastic pumping part 300.

In the present embodiment, as illustrated in FIG. 4, the extended body 220 may have an "L" shape to provide the second space portion 250 between the extended body 220 and the cap body 210.

In the present embodiment, as illustrated in FIG. 4, a stopper protrusion 221 is provided on the outer lower end of the extension body 220, and the stopper protrusion 221 is inserted and coupled to a wall portion 311 of the elastic pumping part 300 to prevent the idling of the elastic pumping part 300.

In the present embodiment, a plurality of stopper protrusions 221 may be provided, and the respective stopper protrusions 221 may be spaced apart from each other.

As illustrated in FIG. 4, the first space portion 240 of the cap part 200 may be provided to have a larger volume than the second space portion 250.

In the present embodiment, the cosmetic contents are sucked or ejected into the pipette member 230 by the pressing force of the elastic pumping part 300, and the first space portion 240 may provide a space in which the ceiling portion 312 of the elastic pumping part 300 descends toward the pipette member 230 or ascends in an opposite direction. In the present embodiment, the second space portion 250 may provide a space in which the air in the first space portion 240 moves and temporarily stays when the ceiling portion 312 ascends or descends.

As illustrated in FIG. 2, the elastic pumping part 300 is directly coupled to the extended body 220 of the cap part 200 to provide a pumping force for sucking or ejecting the cosmetic contents into the pipette member 230.

In the present embodiment, as illustrated in FIG. 4, the elastic pumping part 300 includes the elastic body 310 coupled directly to the extension body 220 and a protrusion portion 320 provided on the inner central portion of the elastic body 310 to structurally reinforce the elastic body 310.

As illustrated in FIG. 4, the elastic body 310 of the elastic pumping part 300 includes the wall portion 311 coupled directly to the side wall of the extension body 220 and the ceiling portion 312 provided on the upper end of the wall portion 311 and moving toward the pipette member 230 to provide a pumping force for sucking or ejecting the cosmetic contents into the pipette member 230.

In the present embodiment, the elastic body 310 may be provided with an elastic material including rubber.

In the present embodiment, the wall portion 311 may be tightly fitted to the extension body 220 or coupled to the extension body 220 using an adhesive harmless to the human body.

In the present embodiment, in order to secure an efficient pumping force while being structurally stable, as illustrated in FIG. 4, a thickness t1 of the ceiling portion 312 in a region where the ceiling portion 312 and the side wall are in contact with each other is the thickest, a thickness t2 of the ceiling portion 312 in a region in contact with the protrusion portion 320 is the thinnest. In addition, a thickness t3 obtained by summing the thickness of the protrusion portion 320 and the thickness of the ceiling portion 312 provided with the protrusion portion 320 may be provided to be equal to the thickness t1 of the ceiling portion 312. In the present embodiment, if the thickness t3 obtained by summing the thickness of the protrusion portion 320 and the thickness of the ceiling portion 312 provided with the protrusion portion 320 is provided too thin, the structure of the central portion of the ceiling portion 312 may be weakened, and if the thickness t3 is provided too thick, an elastic restoring force may be weakened, so that the thickness is determined in consideration of this problem.

As illustrated in FIG. 4, the protrusion portion 320 of the elastic pumping part 300 is provided to protrude toward the pipette member 230 inside the center of the ceiling portion 312 to structurally reinforce the thin region of the ceiling portion 312.

As described above, the present disclosure is not limited to the embodiments described herein, and it will be apparent to those skilled in the art that various changes and modifications may be made without departing from the spirit and the scope of the present disclosure. Therefore, it will be understood that these changes and modifications are included in the appended claims of the present disclosure.

What is claimed is:

1. A cosmetic container comprising:

a container body in which cosmetic contents are stored;

a cap part coupled to the container body and having a pipette member; and an elastic pumping part coupled to the cap part to suck or eject the cosmetic contents stored in the container body with the pipette member, wherein the elastic pumping part includes a wall portion coupled directly to a side wall of the cap part and a ceiling portion provided on the wall portion and moving toward the pipette member to provide a pumping force for sucking or ejecting the cosmetic contents into the pipette member, the ceiling portion is provided with an elastic material including rubber, the wall portion is coupled directly to the side wall of the cap part, and wherein the cap part includes a cap body detachably coupled to the container body;

an extension body provided to extend from an outer lower end of the cap body and coupled directly with the wall portion;

a first space portion provided between an upper surface of the cap body and the ceiling portion; and a second space portion provided between the cap body and the extension body, wherein a volume of the first space portion is larger than a volume of the second space portion, wherein the first space portion and the second space portion are connected to each other, such that air in the first space portion moves to the second space portion when the ceiling portion descends and air in the second space portion moves to the first space portion when the ceiling portion ascends.

2. The cosmetic container of claim 1, wherein the elastic pumping part further includes a protrusion portion provided inside the ceiling portion and protruding toward the pipette member to structurally reinforce a central portion of the ceiling portion.

3. The cosmetic container of claim 2, wherein a thickness of the ceiling portion in a region where the ceiling portion and the side wall are in contact with each other is the thickest, a thickness of the ceiling portion in a region in contact with the protrusion portion is the thinnest, and a thickness obtained by summing the thickness of the protrusion portion and the thickness of the ceiling portion provided with the protrusion portion is provided to be equal to the thickness of the ceiling portion.

* * * * *